United States Patent [19]

Naik

[11] Patent Number: 4,919,773

[45] Date of Patent: Apr. 24, 1990

[54] METHOD FOR IMPARTING EROSION-RESISTANCE TO METALLIC SUBSTRATES

[75] Inventor: Subhash K. Naik, Milford, Conn.

[73] Assignee: Avco Corporation, Providence, R.I.

[21] Appl. No.: 204,070

[22] Filed: Jun. 8, 1988

Related U.S. Application Data

[60] Division of Ser. No. 864,995, May 20, 1986, Pat. No. 4,761,346, which is a continuation-in-part of Ser. No. 672,912, Mar. 19, 1984, abandoned.

[51] Int. Cl.[5] ..... C25D 5/00; C23C 16/00

[52] U.S. Cl. ..... 204/38.4; 204/38.1; 204/192.15; 427/250; 427/255.7; 427/443.1; 427/419.7

[58] Field of Search ..... 204/192.15, 192.16, 204/192.31, 38.1, 38.4, 38.5; 427/37, 38, 250, 255.7, 443.1, 405, 419.7

[56] References Cited

U.S. PATENT DOCUMENTS

| | | | |
|---|---|---|---|
| 3,743,551 | 7/1973 | Sanderson | 204/192.16 X |
| 3,774,703 | 11/1973 | Sanderson | 204/192.16 X |
| 3,802,078 | 4/1974 | Denes | 204/192.16 X |
| 4,209,375 | 6/1980 | Gates et al. | 204/192.16 |
| 4,619,865 | 10/1986 | Keem et al. | 204/192.16 X |

OTHER PUBLICATIONS

Maissel et al., "Handbook of Thin Film Technology", McGraw-Hill Book Co., 1970, pp. 4-17 to 4-19.

*Primary Examiner*—Nam X. Nguyen
*Attorney, Agent, or Firm*—Perman & Green

[57] ABSTRACT

Erosion resistance is imparted to a metallic substrate without an attendant loss of fatigue life in the substrate in one embodiment by applying to the substrate a first ductile layer comprising a metal from Group VI to Group VIII elements as well as the noble metal group of elements, and a second hard erosion-resistant layer applied on the first layer comprising a boride, carbide, nitride or oxide of a metal selected from Group III to Group VI elements, the first layer capable of retaining substrate integrity and preventing diffusion of material from the second layer into the substrate. Another embodiment defines another layer of a substantially pure metal from Group III to Group VI between the first and second layers. Still another embodiment defines that in the second layer the content of either the carbide, nitride, boride or oxide is graded, i.e. the concentration of either the carbide, nitride, boride or oxide is greatest (higher) toward the top surface of the second layer, and decreases toward the bonding surface between the second and first layer.

21 Claims, No Drawings

METHOD FOR IMPARTING EROSION-RESISTANCE TO METALLIC SUBSTRATES

RELATED APPLICATIONS

This application is a division of co-pending application Ser. No. 864,995 filed on May 20, 1986, now U.S. Pat. No. 4,761,364 which is a continuation in part of Ser. No. 672,912 filed Mar. 19, 1984, abandoned.

BACKGROUND OF THE INVENTION

1. Field of the Invention

This invention relates generally to erosion resistant coatings for various substrates, such as steel (e.g. stainless steel) and titanium substrates, and more particularly to novel layered erosion-resistant coatings which may be applied to steel and titanium compressor components of gas turbine engines to provide erosion resistance without exhibiting a sharp drop in fatigue life of the substrate alloy after the coating is applied.

2. The Prior Art

Gas turbine engine compressor blades are conventionally fabricated from various steel and titanium alloys. These blades are typically subjected to severe erosion when operated in sand and dust environments. It is blade erosion that reduces compressor efficiency, requiring premature blade premature blade replacement thereby resulting in increased overall costs.

There are presently available a wide variety of various erosion resistant coatings taught in the prior art such as tungsten and carbon coatings (U.S. Pat. No. 4,147,820), platinum metal coating (U.S. Pat. No. 3,309,292) and boron containing coatings (U.S. Pat. No. 2,822,302). However, these and other known coatings, which have been identified by the art for imparting erosion resistance to metallic substrates,, such as titanium and steel alloy compressor blades, promote sharp drops in fatigue properties of the substrates. This results in the initiation of cracks and fractures with an attendant reduction in the service life of the substrate. This effect on the fatigue life of the substrate is believed due to the fact that the erosion-resistant taught by the prior art are hard materials which produce residual stress and accompanying strains in the substrate thereby accelerating a reduction in the fatigue strength of the substrate. Since this cannot be tolerated, there exists a need in the art to avoid this disadvantage and to produce erosion-resistant coating systems which do not deleteriouslsy affect the fatigue life of the substrate to which they are applied.

There are other examples in the prior art of various attempts to coat metallic substrates similar to the examples described above. They are as follows: U.S. Pat. No. 3,640,689 describes a method of chemical vapor disposition of a hard layer on a substrate. The method includes providing an intermediate layer of a refractory interface barrier, such as a refractory metal, between the substrate and hard coating to prevent deleterious interaction between the substrate and the hard metal layer and to obtain a hard wear surface. A 0.2 mil thickness of tungsten deposited at temperatures of about 1000°-1200° C. is given as an example of an intermediate layer, and several carbide materials (e.g. TiC, HFC and ZrC) are disclosed as the hard metal outer coating for substrates such as cutting tools formed of a cobalt based alloy.

U.S. Pat. No. 3,814,625 describes the coating of certain substrate materials, such as tool steel, bearing steel, carbon or boron fibers with tungsten and/or molybdenum carbide, and in some cases the use of an interlayer of nickel or cobalt between the substrate and coating to provide better adhesion. The patent also describes that when depositing the carbide outer layer, amounts of free metallic tungsten and/or molybdenum can be co-deposited with their carbides, and that some coatings may contain 10% or less by weight of tungsten in elemental form.

U.S. Pat. No. 4,427,445 describes a procedure whereby hard deposits of an alloy of tungsten and carbon are deposited at relatively low deposition temperatures on metallic substrates, such as steel. The substrate can include an interlayer of nickel or copper between the substrate and carbide to protect the substrate from attack by the gases used to deposit the carbide hard coating.

Other similar prior art methods and products are described in U.S. Pat. Nos. 3,890,456, 4,040,870, 4,055,451, 4,147,820, 4,153,483 and 4,239,819.

SUMMARY OF THE INVENTION

It is, therefore, an object of the present invention to provide novel coating systems which are devoid of the above-noted disadvantages.

It is another object of the present invention to provide layered coatings which have good erosion resistance and which do not deleteriously affect the fatigue life of the substrate material upon which they are applied.

It is a further object of this invention to minimize residual stress and accompanying strains in an applied erosion-resistant coating system to ameliorate any deleterious effect of the fatigue life of the coated substrate.

It is still another object of this invention to provide a coating system which may be effectively used in harsh atmospheres of the type in which gas turbine compressor components operate.

It is still another object of this invention to provide a coating system having broad application and that is capable of providing erosion-resistance to a wide variety of gas turbine compressor components without degrading the fatigue life of the components.

It is still another object of this invention to employ a coating on gas turbine compressor components which will avoid erosion, thereby increasing compressor efficiency and thereby reducing overall costs.

The foregoing objects and other objects of the present invention are accomplished by employing an erosion-resistant coating system comprising successively applied layers of different respective materials as defined by the features of the present invention.

One embodiment of the present invention defines a layered erosion-resistant coating system that can be applied to a metallic substrate without causing substantially any resulting loss in fatigue properties of the substrate. This system comprises a first ductile layer on the substrate comprising a metal from Group VI to Group VIII elements as well as the noble metal group of elements and preferably palladium, platinum, nickel or chrominum and a second hard erosion-resistant layer applied on the first layer comprising a boride, carbide, nitride or oxide of a metal selected from Group III to Group VI elements, preferably tungsten, titanium, hafnium, zirconium, aluminum or lanthanum, the first layer capable of retaining substrate integrity and preventing diffusion of material from the second layer into the substrate.

Another embodiment of the present invention defines a layered erosion-resistant coating that can be applied to a metallic substrate without causing substantially any resulting loss in fatigue properties of the substrate which comprises a first ductile layer on the substrate comprising a metal from Group VI to Group VIII elements as well as the noble metal group of elements and preferably palladium, platinum, nickel or chromium, a second layer comprising a substantially pure Group III to Group VI element, preferably tungsten, titanium, hafnium, zirconium, aluminum or lanthanum, and a third hard erosion-resistant layer on the second layer comprising a material formed of a boride, carbide, nitride or oxide of the metal selected from a Group III to Group VI element of tungsten, titanium, hafnium, zirconium, aluminum or lanthanum, the first layer capable of retaining substrate integrity and preventing diffusion of material from the second and third layers into the substrate. It is preferred in accordance with the features of the present invention that the hard outer layer comprises the hard compound state of the particular selected substantially pure metal layer. The layer of substantially pure metal, i.e., tungsten, titanium, hafnium, zirconium, aluminum or lanthanum, (i) tends to improve the adhesiveness and fatigue properties of the coated material.

Still another embodiment of the present invention defines a layered erosion-resistant coating that can be applied to a metallic substrate without causing substantially any resulting loss in fatigue properties of the substrate which comprises a first ductile layer on the substrate comprising a metal from Group VI to Group VIII elements as well as the noble metal group of elements and preferably palladium, platinum, nickel or chromium, and a second hard erosion-resistant layer applied on the first layer comprising a boride, carbide, nitride or oxide of a metal selected from a Group III to Group VI element and preferably tungsten, titanium, hafnium, zirconium, aluminum or lanthanum. However, in this embodiment, the content (percentage) of either the carbide, nitride, boride or oxide is graded, i.e. the concentration of either the carbide, nitride, boride or oxide is greatest (higher) toward the top surface of this second layer and decreases toward the bonding surface between the second and first layer.

The first applied layer, or interlayer, which is applied directly to the titanium or steel substrate, is preferably formed of a ductile material, such as platinum, palladium, nickel or chromium. This ductile layer is capable of retaining structural integrity during processing and preventing diffusion of material from the layer applied above it into or completely through it and thus into the substrate. The substrate is thereby protected from degradation of material or engineering properties. Residual stress and accompanying tensile strains in the coating system are minimized by applying any of the layers at relatively low temperatures, i.e. the coatings can be deposited up to 1800° F. with the preferred deposition temperatures not to exceed 1400° F. which allows for a fine grain and/or a columnar grain structured coating. In accordance with the preferred features of the present invention, the coatings are deposited between about 400° F. to about 1000° F.

In accordane with the features of the present invention, there is provided an erosion resistant hard coating formed of a carbide, boride, oxide, or nitride of tungsten, titanium or lanthanum coated on a titanium or steel alloy substrate in which the deleterious effect of the fatigue life of the substrate which was previously encountered is substantially eliminated. There is also provided by the present invention a substrate with a relatively hard outer coating ranging from about 1400 DPH to about 3500 DPH, and preferably from about 1600 DPH to about 2800 DPH.

DETAILED DESCRIPTION OF THE INVENTION

In the coating systems covered by the present invention, the first layer of ductile metal applied directly adjacent to the titanium or steel alloy substrate will retain substrate integrity during processing and provide a diffusion barrier by preventing material from the second of possibly third layer from diffusing into and degrading the substrate material, and yet does not by itself degrade the substrate material properties when applied thereto.

Most erosion-resistant coatings of for example, the tungsten-carbon, titanium-carbon or the titanium-nitrogen type are brittle and certain components of these coating materials, e.g. carbon, boron, nitrogen and oxygen will, at the temperatures normally used for this type of coating application, embrittle the substrate alloy. Thus, it has been previously determined in work on titanium carbide/nitride coatings on a titanium substrate, that en embrittling alpha case layer is created on the titanium substrate. In the practice of the present invention, it is believed that the ductile first layer applied to the substrate acts as a barrier to the possible diffusion of embrittling components from the carbides, borides, oxides or nitrides onto the substrate layer. This first layer had the additional advantage of acting as a crack arrestor, which by the retardation of the crack propagation rate results in improved fatigue life performance of the substrate.

With respect to the erosion resistant coating layers, the coatings are applied under conditions whereby residual stress and tensile strain in the coatings is minimized to promote retention of fatigue life in the substrate, any strains in the coating system tending to induce cracks in the substrate which deleteriously affect the fatigue life thereof. Specifically, stress in the coating system is a function of the difference in the coefficients of thermal expansion between coating and the substrate material ($\Delta\alpha$) and the difference in temperature between the substrate (room temperature) and the coating deposition temperature ($\Delta T$). Thus stress ($\sigma$) in the coating system can be represented by the formula:

$$\sigma = \Delta\sigma \times \Delta T$$

In view of the formula, stress in the coating can be reduced by either reducing the $\Delta\sigma$ by using a coating material having a coefficient of expansion closely corresponding to that of the substrate of reducing $\Delta T$ by using a lower temperature at which the coating is deposited. In a preferred embodiment of the present invention, the various coatings are applied at temperatures up to about 1800° F., and in accordance with the preferred features of the present invention, at a deposition temperature not to exceed 1400° F. and preferably between about 400° F. and about 1000° F. whereby improved fatigue life of the substrate is achieved.

Any suitable substrate material may be used in combination with the layered coatings of the present invention. Typical substrate materials include steel alloys, such as stainless steels, titanium alloys. nickel base and cobalt base super-alloys, dispersion-strengthened alloys, composites, single crystal and directional eutectics. While many types of suitable substrate material may be used, particularly good results are obtained when stainless steel or titanium alloys are used with the novel coating systems disclosed herein.

Examples of some of the nominal compositions of typical substrate materials that are used in combination with the coating systems in accordance with the features of the present invention include AM350(Fe, 16.5Cr, 4.5Ni, 2.87Mo, 0.10C); AM355(Fe, 15.5CR, 4.5Ni, 2.87Mo, 0.12C); Custom 450(Fe, 15Cr, 6Ni, 1 Mo, 1.5Cu, 0.5Cb, 0.05C); Ti-6Al-4V; Ti-6Al-25n-4zr-2Mo; Ti-6Al-25n-4Zr-6Mo; and Ti-10V-2Fe-3Al.

The first preferred layer or metallic interlay of the coating systems defined by the present invention can be selected from Group VI to Group VIII elements as well as the noble metal group of elements, and preferably contains a metal, such as palladium, platinum, nickel or chromium. While any suitable palladium, platinum, nickel or chromium containing metal may be used, in several cases nickel or palladium is preferred, especially when stainless steel is the substrate being coated. Platinum or nickel is preferred when a titanium alloy is used as the substrate material being coated. This first layer of a palladium, platinum, nickel, or chromium containing metal, as already discussed, acts as a diffusion barrier and protects the substrate integrity during further coating with the hard carbide, boride, oxide or nitride overlayer.

The metallic interlayer, of this invention exhibits particularly good results when the thickness of the first palladium, nickel, or chromium containing layer is between about 0.1 and about 1.5 mils. In accordance with the preferred features of the present invention, this metallic interlayer should be about 0.2 to about 0.8 mils. An even more preferred thickness range is from about 0.2 to about 0.3 mils.

Any suitable coating technique may be used to apply the first layer or metallic interlayer of the coating to the substrate material. Typical methods include electroplating, sputtering, ion-plating, electrocladding, pack coating, and chemical vapor deposition, among others. While any suitable technique may be used, it is preferred to employ an electro/electroless plating, vapor deposition or overlay/physical vapor process. In practicing the coating procedure of the present invention, the surface of the substrate to be coating is preferably first shot peened to provide compressive stressed therein. The shot peened surface is then thoroughly cleaned with a detergent, chlorinated solvent, or acidic or alkaline cleaning reagents to remove any remaining oil or light metal oxides, scale or other contaminants.

To insure good adherence of the first layer of, for example, platinum, palladium, nickel or chromium, the cleaned substrate is activated to effect final removal of absorbed oxygen. As already indicated, the first layer can be applied to the surface of the substrate by such conventional coating techniques ss electroplating, chemical vapor deposition (CVD), sputtering or ion plating. If electroplating is the coating method chosen, then activation of the substrate surface is conveniently accomplished by anodic or cathodic electrocleaning in an alkaline or acidic bath by the passage therethrough of the required electrical current. Plating is then accomplished using conventional plating baths such as a Watts nickel sulfanate bath or a platinum/palladium amino nitrate bath. If CVD is elected for the coating application, then activation is accomplished by the passage of a hydrogen gas over the substrate surface. CVD is then accomplished using the volatilizable halide salt of the metal to be deposited and reacting these gases with hydrogen or other gases at the appropriate temperature, e.g. below about 1800° F. to effect deposition of the metallic layer.

If sputtering is chosen as the method of coating application, bias sputtering can be used to activate the substrate. Deposition of the first metallic interlayer is accomplished with sputtering or ion-vapor plating using high purity targets of the metals chosen to form the interlayer.

Various suitable techniques, likewise, may be used to apply the hard erosion-resistant carbide, boride, oxide or nitride layer to the palladium, platinum, nickel or chromium interlayer. Preferred methods of achieving this low temperature deposition include electro/electroless plating, vapor deposition (chemical vapor deposition-CVD) or overlay/physical vapor disposition processes including the "arc-activated PVD process. In this process metal evaporation is achieved by controlled electrical arc discharges and the hard compounds are formed by reacting it with suitable reactive gases (e.g. Nz) during the process.

Coating application of the layer of carbides, borides, oxides or nitrides over the first metallic layer as already discussed is accomplished at a temperature not exceeding about 1800° F. by, for example, CVD or other suitable coating processes. In any event, the layer of carbides, borides, oxides or nitrides is applied to a preferred thickness of about 0.2 to about 1.5 mils.

The embodiment of this invention which employs a first ductile material interlayer followed by a layer of a substantially pure Group III to Group VI element and then a layer of a material formed of a boride, carbide, nitride or oxide of a metal selected form a Group III to Group VI element exhibits particularly good results when the thickness of the substantially pure metal layer selected from Group III to Group VI is up to about 1.5 mils and the boride, carbide, nitride or oxide layer is up to about 2.5 mils. In accordance with the preferred features of the present invention, the thickness of the substantially pure metal layer is about 0.2 to about 1.0 mils and the boride, carbide, nitride or oxide layer is about 0.2 to about 1.5 mils. An even more preferred range has the thickness of the substantially pure metal layer at about 0.2 to about 0.6 mils and the boride, carbide, nitride or oxide layer at about 0.2 to about 1.0 mil. It is preferred in accordance with the features of the present invention that the hard outerlayer should be of the hard compound state of the selected respective substantially pure metal layer. By controlling the thickness of these layers to the critical parameters listed above, spalling is substantially prevented.

It is also within the scope of the present invention to even further improve the bonding properties of the above-described layer formed of a boride, carbide, nitride or oxide of a Group III to Group VI metal. This can be accomplished by grading the boride, carbide, nitride or oxide content in this layer, i.e. having the concentration of the boride, carbide, nitride or oxide being greatest (higher) toward the top surface of this layer and decreasing toward the bonding surface between this layer and the metallic interlayer. This defines one preferred concept in accordance with the features of the present invention wherein the hard outerlayer may be deposited either in a compound form (as described above) or be intentionally graded/transitioned from the metallic state (at the interface with the metallic interlayer) to the fully hard compound state of the respective element at the top surface of the hard layer. The concept of a graded layer as defined by the present invention can be achieved (for example if CVD is the chosen process) through the adjustment of the gas flows during processing.

As stated above, the outer hard layer in accordance with the features of the present invention can be selected from the carbides, borides, nitrides or oxides of Group III to Group VI elements, preferably the elements tungsten, titanium, hafnium, zirconium, aluminum or lanthanum. These hard compounds can be deposited either in the substoichiometric or stoichiometric (with or without excess of interstitial elements) form. The preferred combinations of possible layered coating systems in accordance with the features of the present invention can be selected from the following general formula:

| |
|---|
| Interlayer (Ni, Pt, Pd, Cr - either singularly or in combination) + Hard Coating [(Al, La, Ti, Zr, HF, W) -(B,C,O,N)] |

A few typical examples of coating systems from the above formula are enumerated as follows:

| | |
|---|---|
| (1) | interlayer - nickel<br>hard layer - lanthanum boride |
| (2) | interlayer - platinum<br>hard layer - titanium nitride |
| (3) | interlayer - chromium<br>hard layer - tungsten carbide |
| (4) | interlayer - nickel<br>hard layer - aluminum oxide |
| (5) | interlayer - nickel<br>hard layer - titanium boride |
| (6) | interlayer - platinum<br>pure metal layer - titanium<br>hard layer - titanium nitride |
| (7) | interlayer - nickel<br>hard layer - titanium nitride |
| (8) | interlayer - nickel<br>pure metal layer - titanium<br>hard layer - titanium nitride |
| (9) | interlayer - palladium<br>hard layer - hafnium nitride |
| (10) | interlayer - nickel<br>pure metal layer - hafnium<br>hard layer - hafnium nitride |
| (11) | interlayer - nickel<br>pure metal layer - zirconium<br>hard layer - zirconium nitride or carbide |
| (12) | interlayer - platinum<br>pure metal layer - hafnium<br>hard layer - hafnium nitride |
| (13) | interlayer - nickel<br>pure metal layer - titanium<br>hard layer - titanium boride |

In accordance with the features of the present invention novel coating systems have been provided which are capable of preventing or reducing the erosion of metals such as steel and alloys thereof, particularly in an operating environment such as a gas turbine engine. This is accomplished without substantial degradation of material properties of the structure to which the coating system is applied.

While specific components of the present system are defined above, many other variables may be introduced which may in any way affect, enhance, or otherwise improve the system of the present invention. These are intended to be included herein.

Although variations are shown in the present application, many modifications and ramifications will occur to those skilled in the art upon a reading of the present disclosure. These, too, are intended to be included herein.

I claim:

1. A method for imparting erosion-resistance to a metallic substrate without an attendant loss in the fatigue life of the substrate which comprises applying to the substrate a first ductile barrier layer having a thickness between about 0.1 and 1.5 mils comprising a metal selected from the noble metal group of elements, in direct contact with the substrate, applying a second layer of pure metal selected from Group III to Group VI elements having a thickness between about 0.2 and 1.5 mils to said first layer, and then applying at substantially low temperatures, above about 400° F., a third layer which overcoates the second layer, the third layer having a thickness between about 0.2 and 2.5 mils and comprising a hard material formed of a boride, carbide, nitride or oxide of a metal selected from Group III to Group VI elements, the first layer being capable of retaining substrate integrity and preventing diffusion of material from the second layer into the substrate.

2. The method of claim 1 wherein said first and third layers are deposited at temperatures between about 400° F. and 1800° F.

3. The method of claim 1 wherein said first and third layers are deposited at temperature not exceeding about 1400° F.

4. The method of claim 1 wherein said first and third layers are deposited at temperatures between about 400° F. and about 1000° F.

5. The method of claim 1 wherein low temperature deposition of said first and third layers is achieved by electro/electroless plating, chemical vapor deposition or overlay/physical vapor deposition processes.

6. The method of claim 1 wherein the concentration of said boride, carbide, nitride or oxide is greatest toward the top surface of said third layer and is graded to decrease in concentration toward the bonding surface between said third and second layers.

7. The method of claim 1 wherein said substrate is a stainless steel or titanium alloy.

8. The method of claim 1 wherein the hardness of said third layer ranges from about 1400 DPH to about 3500 DPH.

9. The method of claim 1 in which the first layer is applied at a thickness between about 0.2 and 0.8 mil.

10. The method of claim 1 in which the first layer is applied at a thickness between about 0.2 and 0.3 mil.

11. The method of claim 1 in which the third layer is applied at a thickness between about 0.2 and 1.5 mil.

12. The method of claim 1 in which the third layer is applied at a thickness between about 0.2 and 1.0 mil.

13. The method of claim 1 in which the second layer is applied at a thickness between about 0.2 and 1.0 mil.

14. The method of claim 1 in which the second layer is applied at a thickness between about 0.2 and 0.6 mil.

15. The method of claim 1 in which the total coating thickness ranges between about 0.4 and 4.0 mils.

16. The method of claim 1 in which the hardness of said second layer ranges from about 1400 DPH to about 3500 DPH.

17. The method of claim 1 in which said first layer comprises palladium or platinum.

18. The method of claim 1 in which the metal of said third layer is aluminum, lanthanum, titanium, zirconium, hafnium or tungsten.

19. The method of claim 1 in which said third layer is selected from the group consisting of titanium nitride, titanium boride, lanthanum boride, tungsten carbide, aluminum oxide and hafnium nitride.

20. The method of claim 1 in which the metal of said third layer is the same metal as present in the second layer.

21. The method of claim 20 in which the second layer comprises tungsten and the third layer comprises tungsten carbide.

* * * * *